US007201120B2

(12) United States Patent
Geyer et al.

(10) Patent No.: US 7,201,120 B2
(45) Date of Patent: Apr. 10, 2007

(54) TWO-CYCLE ENGINE

(75) Inventors: Werner Geyer, Berglen (DE); Lukas Zürcher, Stuttgart (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/395,951

(22) Filed: Mar. 31, 2006

(65) Prior Publication Data

US 2006/0219194 A1 Oct. 5, 2006

(30) Foreign Application Priority Data

Apr. 2, 2005 (DE) ..... 10 2005 015 164

(51) Int. Cl.
*F02B 33/04* (2006.01)

(52) U.S. Cl. ..... 123/73 PP; 123/73 A; 261/DIG. 12; 261/DIG. 52

(58) Field of Classification Search ..... 123/73 PP, 123/73 AA; 261/DIG. 12, DIG. 52
See application file for complete search history.

(56) References Cited

U.S. PATENT DOCUMENTS 6,101,991 A 8/2000 Glover

*Primary Examiner*—Noah P. Kamen
(74) *Attorney, Agent, or Firm*—Robert W Becker & Associates; Robert W Becker

(57) ABSTRACT

A two-cycle engine having a piston reciprocalbly mounted in a cylinder in which a combustion chamber is formed. In prescribed positions of the piston, the combustion chamber communicates with a crankcase via at least one transfer channel. A portion of an intake channel for supplying fuel/air mixture and combustion air is formed in a carburetor, in which is pivotably mounted a butterfly valve for controlling the flow cross-section of the intake channel. A fuel opening opens into the intake channel portion, and downstream of the carburetor the intake channel is divided into a mixture channel and an air channel. A mechanism is disposed on the butterfly valve to increase the speed of flow in the carburetor in the vicinity of the fuel opening.

20 Claims, 3 Drawing Sheets

TWO-CYCLE ENGINE

The instant application should be granted the priority date of Apr. 2, 2005, the filing date of the corresponding German patent application 10 2005 015 164.7.

BACKGROUND OF THE INVENTION

The present invention relates to a two-cycle engine, especially one in a manually-guided implement such as a power saw, a brush cutter, a cut-off machine, or the like.

U.S. Pat. No. 6,101,991 discloses a two-cycle engine having an intake duct or channel that is divided into an air channel and a mixture channel. The two-cycle engine has a carburetor in which a butterfly valve is pivotably mounted in a portion of the intake channel. In the completely opened position, the butterfly valve rests against the edge of a ring-shaped element. Downstream of the throttle shaft, a partition that divides the intake channel adjoins the ring-shaped element. Opening into the intake channel is a fuel opening that upstream of the butterfly valve is disposed at a level to which the ring-shaped element just reaches.

It has been shown that in particular in full throttle operation, in other words when the butterfly valve is disposed approximately parallel to the direction of flow in the intake channel, fuel can pass into the air channel. Due to the pulsations in the intake channel, the fuel passes into the air channel upstream of the butterfly valve. The air that is supplied to the two-cycle engine via the air channel serves to separate the fuel/air mixture in the crankcase from the exhaust gases in the combustion chamber, and to prevent fresh, non-combusted fuel/air mixture from escaping out of the combustion chamber through the outlet. The fuel that passes into the combustion chamber through the air channel can escape out of the combustion chamber with the exhaust gases, thus impairing the quality of the exhaust gas emissions.

It is an object of the present application to provide a two-cycle engine of the aforementioned general type that has lower emission values and has a straightforward construction.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
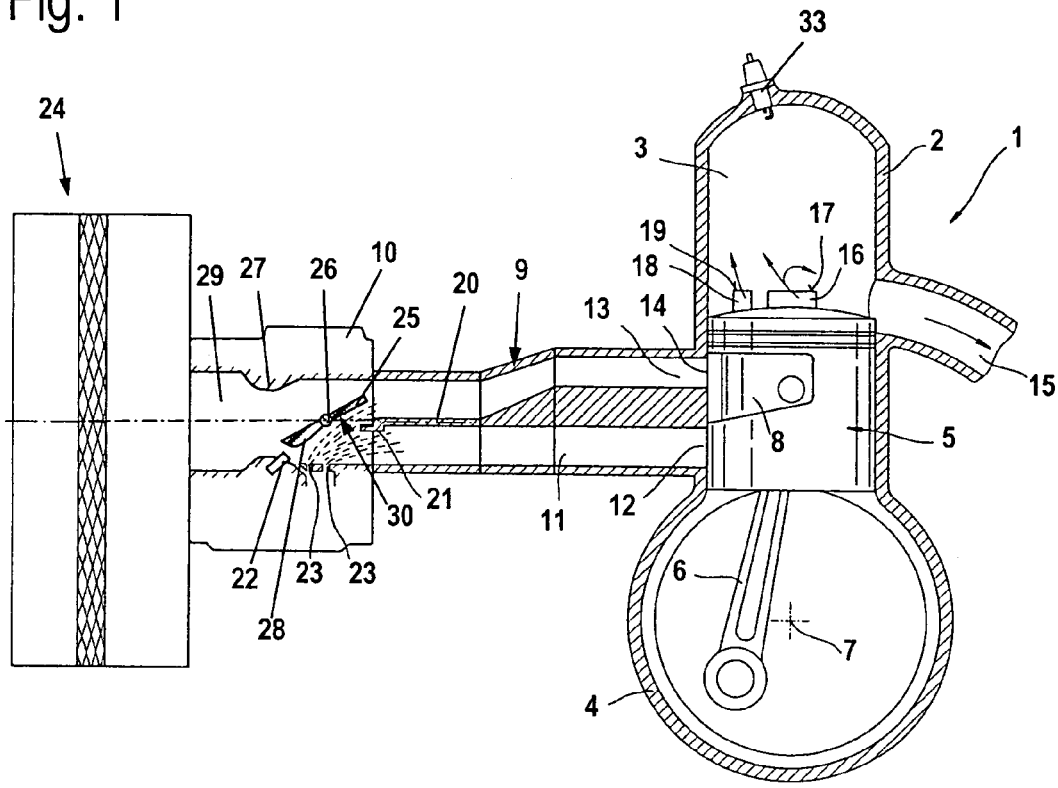
FIGS. 1 & 2 show illustrations of a two-cycle engine.

The two-cycle engine of the present application comprises a cylinder having a combustion chamber formed therein; a piston reciprocably mounted in the cylinder, wherein in prescribed positions of the piston the combustion chamber is in communication with a crankcase via at least one transfer channel; an intake channel for supplying fuel/air mixture and combustion air; a carburetor, wherein a portion of the intake channel is formed in the carburetor; a butterfly valve pivotably mounted in the carburetor for controlling the flow cross-section of the intake channel, wherein a fuel opening opens into the intake channel portion, and wherein downstream of the carburetor the intake channel is divided into a mixture channel and an air channel; and means disposed on the butterfly valve for increasing the speed of flow in the carburetor in the vicinity of the fuel opening.

Due to the increase of the speed or velocity of flow in the region of the fuel opening, the fuel is supplied to the two-cycle engine via the mixture channel. A passage of fuel into the air channel can thereby be substantially avoided.

The means for increasing the flow velocity is preferably disposed on that side of the throttle valve that in the completely opened position of the throttle valve faces a section of the intake channel that is disposed upstream of the mixture channel. The means for increasing the flow velocity is, in particular, embodied as a flow-directing element.

A flow-directing element on the butterfly valve leads to an alteration of the flow when the butterfly valve is completely opened. As a result, it is possible to influence the flow in that section of the intake channel that is disposed upstream of the mixture channel and into which the fuel opening opens. The flow-directing element can be embodied in such a way that the flow is accelerated at the fuel opening, thus ensuring an adequate supply of fuel.

The flow-directing element is disposed on a that portion of the butterfly valve that is disposed upstream of the throttle shaft when the butterfly valve is completely opened. As a result, the flow-directing element can influence the flow in the region of the fuel opening, whereas downstream of the throttle shaft there is substantially no influence upon the flow. The flow-directing element preferably reduces the flow cross-section in the intake channel. This results in an acceleration of the flow, which leads to an improved drawing-in of fuel from the fuel opening. However, the flow-directing element can also be disposed on that portion of the butterfly valve that is disposed downstream of the throttle shaft when the butterfly valve is completely opened. The flow-directing element is in particular secured to the butterfly valve. In this connection, the flow-directing element can be clipped onto the butterfly valve or screwed or otherwise secured to the throttle shaft. However, it can also be advantageous to monolithically form the flow-directing element with the butterfly valve. The flow-directing element is preferably made of polymeric material, in which case the surface of the element that influences the flow can have substantially any shape. A flow-directing element made of polymeric material is easy and economical to manufacture, and brings about an only minimal increase in the weight of the two-cycle engine.

A venturi section can be formed in the carburetor in a portion thereof disposed upstream of the mixture channel, and the fuel opening can open into the intake channel in the venturi section. When the butterfly valve is completely opened, the fuel opening is preferably disposed in the intake channel at the level of the flow-directing element. Due to the presence of the flow-directing element, the fuel opening at the venturi section can be offset downstream relative to conventional configurations. Despite the fact that the fuel opening is offset downstream, due to the flow-directing element an adequate flow velocity can be achieved at the fuel opening, thus ensuring a good drawing-in of fuel. Arranging the fuel opening at the level of the flow-directing element, and not upstream of the throttle valve as is the case with conventional configurations, leads to a drawing of the fuel into the mixture channel; the fuel cannot pass into the air channel. The fuel opening preferably opens into the intake channel directly adjacent to the pivot region of the butterfly valve. The fuel opening is accordingly offset downstream as far as possible. However, pivoting of the butterfly valve must not be obstructed by the fuel opening. The fuel opening is a main fuel opening, and at least one secondary fuel opening opens into the intake channel downstream of the main fuel opening. At least one secondary fuel opening is disposed downstream of the butterfly valve when the latter is closed, so that a small quantity of fuel can also be supplied during idling.

A straightforward configuration of the two-cycle engine results if the intake channel is divided by a partition into an air channel and a mixture channel. One end of the partition is disposed at the downstream end face of the carburetor. The partition does not extend into the carburetor housing, but rather ends essentially at the end face of the carburetor. In this way, guide means for the partition in the interior of the carburetor can be eliminated, so that a conventional carburetor can be utilized. To influence the flow distribution between air channel and mixture channel, a narrowed section is formed in the carburetor in a section of the intake channel that is disposed upstream of the air channel. The narrowed section is preferably disposed approximately at the level of the butterfly valve. The narrowed section is in particular formed by the venturi section. However, the venturi section can also extend in the carburetor only in that section of the intake channel that is disposed upstream of the mixture channel, while a narrowed section that is separate from the venturi section is disposed in the carburetor in that section of the intake channel that is disposed upstream of the air channel. In this connection, the narrowed section can also be disposed on the butterfly valve.

Further specific features of the present application will be described in detail subsequently.

DESCRIPTION OF SPECIFIC EMBODIMENTS

Referring now to the drawings in detail, the two-cycle engine 1 shown in FIG. 1 is embodied as a crankcase scavenging two-cycle engine, and preferably is provided for installation in a manually-guided implement such as a power saw, a cut-off machine, a brush cutter, or the like. The two-cycle engine 1 has a cylinder 2 in which is formed a combustion chamber 3, which is delimited by a piston 5 that is reciprocably mounted in the cylinder 2. By means of a connecting rod 6, the piston 5 drives a crankshaft 7 that is rotatably mounted in a crankcase 4. The crankshaft 7 preferably drives the tool of the implement. In the region of the lower dead center point of the piston 5 shown in FIG. 1, the crankcase 4 communicates with the combustion chamber 3 via two transfer channels 16 and two transfer channels 18. One transfer channel 16 and one transfer channel 18 are disposed in front of the drawing plane of FIG. 1 and are therefore not illustrated. The transfer channels 16 and 18 open via transfer windows 17 and 19 into the combustion chamber 3. Leading out of the combustion chamber 3 is an outlet 15, which is port-controlled by the piston 5 and is opened in the lower dead center position of the piston 5 shown in FIG. 1.

The two-cycle engine 1 is connected via an intake channel 9 with an air filter 24, by means of which the two-cycle engine 1 draws in combustion air. A portion 29 of the intake channel 9 is formed in a carburetor 10 in which fuel is supplied to the drawn-in combustion air via a main fuel opening 22 and auxiliary or secondary fuel openings 23. The main fuel opening 22 is disposed at a venturi section 27, which extends about the entire periphery of the intake channel portion 29. The secondary fuel openings 23 are disposed downstream of the main fuel opening 22. A butterfly valve 25 is pivotably mounted in the carburetor 10 on a throttle shaft 26. In FIG. 1, the butterfly valve 25 is shown in the halfway throttle position. In this position, the butterfly valve 25 reduces the flow cross-section in the intake channel portion 29. The butterfly valve 25 is pivotable between a full throttle position in which the butterfly valve 25 is disposed approximately parallel to the direction of flow in the intake channel 9 and only insignificantly affects the flow cross-section, and an idling position, in which the throttle valve 25 substantially closes the flow cross-section in the intake channel 9. Downstream of the carburetor 10, the intake channel 9 is divided into a mixture channel 11 and an air channel 13 by a partition 20, which extends parallel to the direction of flow. The mixture channel 11 opens into the crankcase 4 via a mixture inlet 12, which is port-controlled by the piston 5 and is opened to the crankcase 4 when the piston 5 is in its upper dead center position. However, the mixture inlet can also be embodied in such a way that it is pressure-controlled by a check valve or the like. A control via the crank webs of the crank shaft 7 is also possible. The air channel 13 opens out at the cylinder bore via an air inlet 14. In the region of the upper dead center point of the piston 5, the air inlet 14 communicates with the transfer windows 17 and 19 of the transfer channels 16 and 18 via piston pockets 8 formed in the piston 5.

During operation of the two-cycle engine 1, when the piston 5 is moving upwardly, fuel/air mixture is drawn into the crankcase 4 via the mixture inlet 12. In the vicinity of the upper dead center position of the piston 5, the transfer channels 16 and 18, proceeding from their transfer windows 17 and 19, are flushed by the largely fuel-free air from the air channel 13. During the downward movement of the piston 5, the fuel/air mixture in the crankcase 4 is compressed. As soon as the transfer windows 17 and 19 open toward the combustion chamber 3, first the temporarily collected, largely fuel-free air, and subsequently fuel/air mixture, flow through the transfer channel 16 and 18 and into the combustion chamber 3. During the upward movement of the piston 5, the mixture in the combustion chamber 3 is compressed, and in the vicinity of the upper dead center position of the piston 5 is ignited by a spark plug that projects into the combustion chamber 3. As a consequence of the combustion, the piston 5 is accelerated in a direction toward the crankcase 4. As soon as the outlet 15 is opened by the piston 5, the exhaust gases can escape from the combustion chamber 3. The largely fuel-free air flows through the transfer channels 16 and 18 into the combustion chamber 3 and separates the exhaust gasses that are escaping via the outlet 15 from the following fresh mixture.

Figure 2:
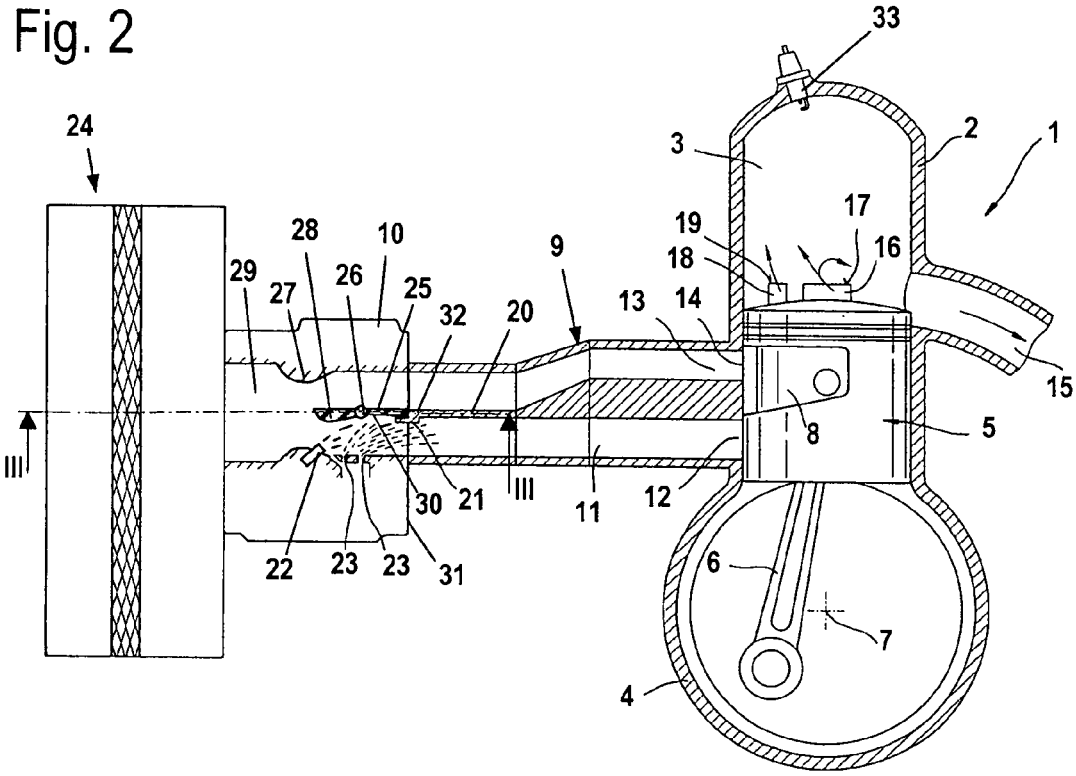

In FIG. 2, the two-cycle engine 1 is shown with the butterfly valve 25 in the full throttle position. In order to achieve good exhaust gas emission values during full throttle operation, it is desirable for the combustion air that is supplied to the two-cycle engine 1 through the air channel 13 to be largely free of fuel. Due to the pressure fluctuations in the intake channel 9, however, back pulsations can occur, so that fuel can pass out of the fuel opening 22 into the air channel 13. To avoid this, a flow-directing element 28 is disposed on that side 30 of the butterfly valve 25 that faces a section of the intake channel 9 that is disposed upstream of the mixture channel 11 and into which the fuel openings 22, 23 open. In the completely opened position of the butterfly valve 25 shown in FIG. 2, the flow-directing element 28 is disposed upstream of the throttle shaft 26. The flow-directing element 28 is monolithically formed with the butterfly valve 25, and can, for example, be made of polymeric material. However, the flow-directing element 28 can, together with the butterfly valve 25, also be made of metal. The flow-directing element 28 has the approximate shape of a wing or a lifting surface, and leads to a narrowing of the section of the intake channel 9 disposed upstream of the mixture channel 11. The flow-directing element 28 is disposed approximately at the level of the fuel opening 22. Accordingly, the fuel opening 22 is offset in the intake channel 9 in the direction of flow toward the two-cycle engine 1. The flow-directing element 28 effects an acceleration of the flow in the region of the fuel opening 22. As a result, a flow that is directed toward the two-cycle engine 1 can be produced. Due to the acceleration of the flow, the fuel opening 22 can be disposed on the downstream side of the venturi section 27. Due to the accelerated flow, an adequate supply of fuel to the two-cycle engine 1 can be achieved. The partition 20 extends to the downstream end face 31 of the carburetor 10. The end 32 of the partition 20 is thus disposed at the end face 31 of the carburetor 10. Only a tip 21, which is formed on the partition 20, extends into the intake channel portion 29 that is formed in the carburetor 10 (see also FIG. 3). Consequently, the carburetor 10 can be configured in the conventional manner. No guides nor additional devices need to be provided for the arrangement of a partition in the carburetor 10 since due to the flow-directing element 28, a good separation of the combustion air from the fuel/air mixture is ensured. In the completely opened position, the butterfly valve 25 rests on the tip 21, which thus forms a stop or abutment for the butterfly valve.

Figure 3:
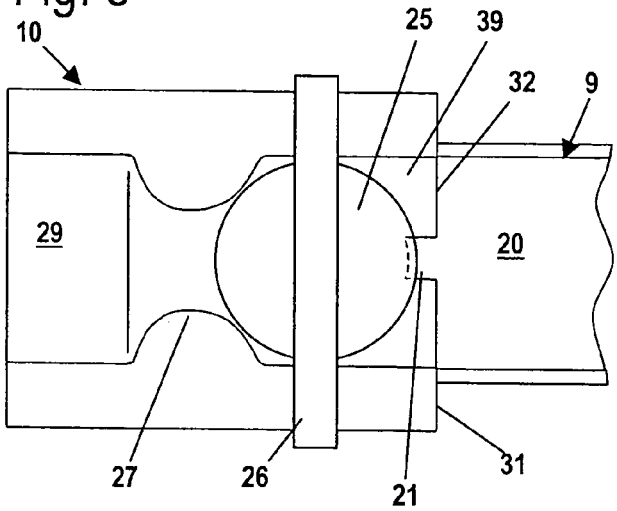
FIG. 3 is a cross-sectional view through the carburetor of FIG. 2 taken at the level of the line III—III thereof.

As shown in FIG. 3, an opening 39, which is divided by the tip 21, is formed between the partition 20 and that portion of the butterfly valve 25 disposed downstream of the throttle shaft 26. Nevertheless, it has been shown that with a suitable configuration of the flow-directing element 28, no fuel, or only an insignificant quantity of fuel, can pass into the air channel 13. However, it can also be advantageous for the partition 20 to be extended into the intake channel portion 29 up to the butterfly valve 25 or up to the throttle shaft 26.

Figure 4:
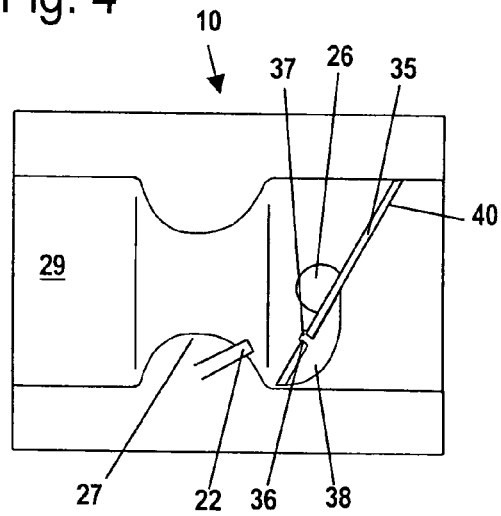
FIGS. 4–8 are longitudinal cross-sectional views through carburetors.
Figure 5:
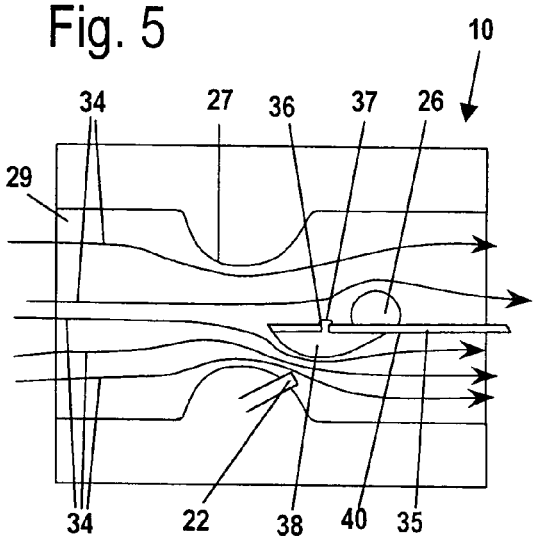

FIGS. 4 and 5 show another exemplary embodiment of a carburetor 10. A butterfly valve 35 is pivotably mounted on the throttle shaft 26 of the carburetor 10. A flow-directing element 38 is secured on that side 40 of the butterfly valve 35 that is disposed downstream in the closed position shown in FIG. 4. The flow-directing element 38 is clipped onto the butterfly valve 35. For this purpose the butterfly valve 35 has an opening 36, which is in particular embodied as a bore or hole. A stop connector 37, which is formed on the flow-directing element 38, is snapped into the opening 36. The flow-directing element 38 is preferably made of polymeric material. The flow-directing element 38 can also be held on the outer periphery of the butterfly valve 35 by means of an arresting device.

In FIG. 5, the butterfly valve 35 is shown in the full throttle position, in which it extends substantially parallel to the direction of flow in the intake channel portion 29. This direction of flow is indicated by the arrows 34. In the region between the fuel opening 22 and the flow-directing element 38, the flow velocity is increased. This is indicated by the arrows 34 that are disposed close to one another. This results in a good drawing-in of fuel from the fuel opening 22, even though the fuel opening 22 is disposed downstream of the venturi section 27 in the intake channel 9. The fuel opening 22 is disposed immediately adjacent to the pivot area of the butterfly valve 26.

Figure 6:
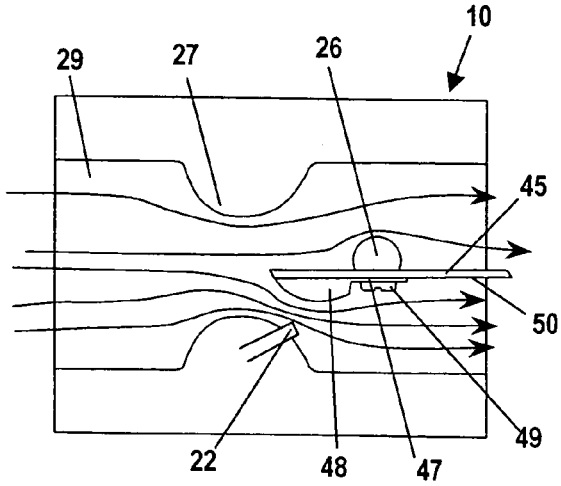

FIG. 6 shows a carburetor 10 in which a butterfly valve 45 is pivotably mounted. A flow directing element 48 is secured on that side 50 of the butterfly valve 45 that faces the section of the intake channel portion 29 that is disposed upstream of the mixture channel 11. The flow-directing element 48 has a securement section 47 that is fastened to the throttle shaft 26 by means of a screw 49. The butterfly valve 45 is disposed between the securement section 47 and the throttle shaft 26, so that the screw 49 secures both the flow-directing element 48 and the butterfly valve 45 to the throttle shaft 26.

In the illustrated embodiments, the venturi section 27 extends about the entire periphery of the intake channel portion 29. However, it can also be advantageous for the venturi section 27 to extend only in that section of the intake channel portion 29 that is disposed upstream of the mixture channel 11, while no venturi section is provided upstream of the air channel 13. The venturi section 27 reduces the flow cross-section in the intake channel portion 29, and thus forms a narrowed section. In addition to, or instead of, the venturi section 27 that is formed upstream of the air channel 13, some other type of narrowed section can be provided upstream of the air channel 13. The narrowed section of the flow cross-section upstream of the air channel 13 influences the distribution of flow in the intake channel 9. By means of a suitable configuration of the narrowed section, it is possible to influence the ratio of fuel/air mixture and combustion air, and to prevent fuel from passing over into the air channel 13. The narrowed section can, for example, be formed by a thickened portion disposed on that side of the butterfly valve that is opposite the flow-directing element.

Figure 7:
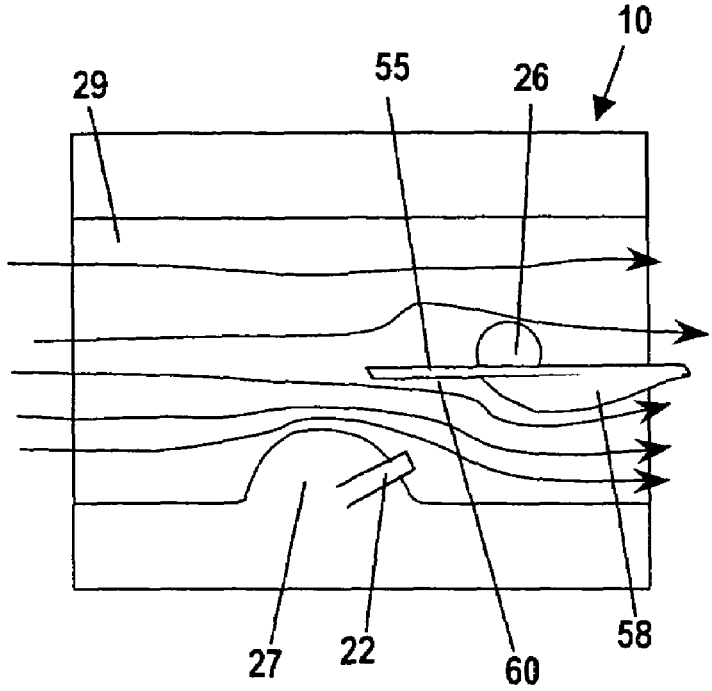

An embodiment of a carburetor 10 having no venturi section upstream of the air channel 13 is shown in FIG. 7. Here the venturi section 27 extends merely in that section of the intake channel portion 29 that is disposed upstream of the mixture channel 11. The carburetor 10 shown in FIG. 7 has a butterfly valve 55 that is provided with a flow-directing element 58 on that side 60 thereof that faces the fuel opening 22. The flow-directing element 58 is disposed downstream of the throttle shaft 26, and reduces the flow cross-section in that section of the intake channel portion 29 that is disposed upstream of the mixture channel 11. This results in an increase of the flow velocity at the fuel opening 22.

Figure 8:
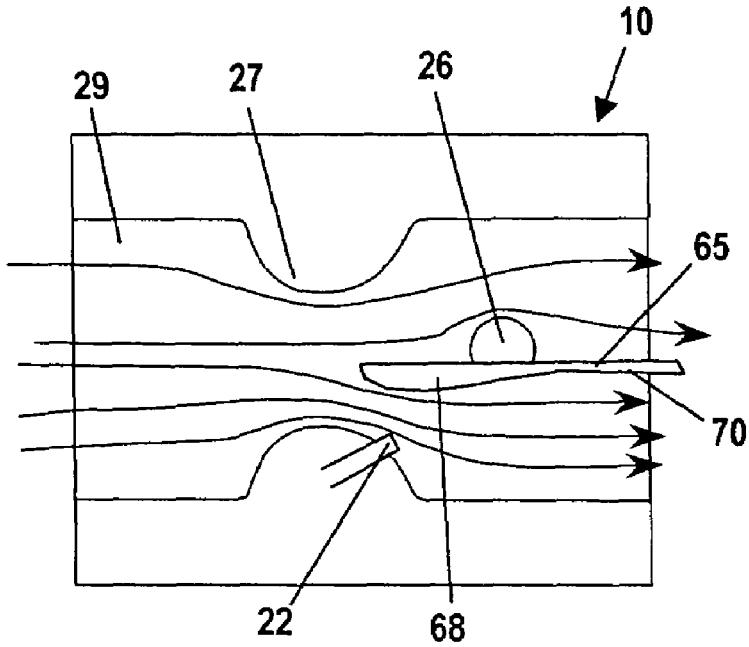

In the carburetor 10 shown in FIG. 8, the flow-directing element 68 is disposed upstream of the throttle shaft 26 on the side 70 of the butterfly valve 65 that faces that section of the intake channel portion 29 that is disposed upstream of the mixture channel 13. The flow-directing element 68 is embodied as a guide contour that is impressed into the butterfly valve 65. As a result, no additional components are required for the flow-directing element 68.

The specification incorporates by reference the disclosure of German priority document 10 2005 015 164.7 filed Apr. 2, 2005.

The present invention is, of course, in no way restricted to the specific disclosure of the specification and drawings, but also encompasses any modifications within the scope of the appended claims.

What we claim is:

1. A two-cycle engine, comprising:

a cylinder, wherein a combustion chamber is formed in said cylinder;

a piston reciprocably mounted in said cylinder, wherein in prescribed positions of said piston said combustion chamber is in communication with a crankcase via at least one transfer channel;

an intake channel for the supply of fuel/air mixture and combustion air;

a carburetor, wherein a portion of said intake channel is formed in said carburetor;

a butterfly valve pivotably mounted in said carburetor for a control of a flow cross-section of said intake channel, wherein a fuel opening opens into said intake channel portion, and wherein downstream of said carburetor said intake channel is divided into a mixture channel and an air channel; and means disposed on said butterfly valve and adapted to increase a speed of flow in said carburetor in a vicinity of said fuel opening.

2. A two-cycle engine according to claim 1, wherein said means adapted to increase the speed of flow in said carburetor is disposed on a side of said butterfly valve that in a completely opened position of said butterfly valve faces a section of said intake channel that is disposed upstream of said mixture channel.

3. A two-cycle engine according to claim 1, wherein said means adapted to increase the speed of flow in said carburetor is embodied as a flow-directing element.

4. A two-cycle engine according to claim 3, wherein said flow-directing element is disposed on a section of said butterfly valve that is disposed upstream of a throttle shaft when said butterfly valve is completely opened.

5. A two-cycle engine according to claim 3, wherein said flow-directing element is disposed on a portion of said butterfly valve that is downstream of a throttle shaft when said butterfly valve is completely opened.

6. A two-cycle engine according to claim 3, wherein said flow-directing element reduces a flow cross-section in said intake channel.

7. A two-cycle engine according to claim 3, wherein said flow-conducting element is secured to said butterfly valve.

8. A two-cycle engine according to claim 7, wherein said flow-directing element is clipped onto said butterfly valve.

9. A two-cycle engine according to claim 7, wherein said flow-directing element is screwed onto a throttle shaft.

10. A two-cycle engine according to claim 3, wherein said flow-directing element is monolithically formed with said butterfly valve.

11. A two-cycle engine according to claim 3, wherein said flow-directing element is made of polymeric material.

12. A two-cycle engine according to claim 3, wherein when said butterfly valve is completely opened, said fuel opening is disposed in said intake channel at a level of said flow-directing element.

13. A two-cycle engine according to claim 1, wherein a venturi section is formed in said carburetor in a section thereof disposed upstream of said mixture channel, and wherein said fuel opening opens into said intake channel at said venturi section.

14. A two-cycle engine according to claim 1, wherein said fuel opening opens out into said intake channel directly adjacent to a pivot region of said butterfly valve.

15. A two-cycle engine according to claim 1, wherein said fuel opening is a main fuel opening, and wherein at least one secondary fuel opening opens out into said intake channel downstream of said main fuel opening.

16. A two-cycle engine according to claim 1, wherein a partition is provided to divide said intake channel into said air channel and said mixture channel.

17. A two-cycle engine according to claim 16, wherein an end of said partition is disposed on a downstream end face of said carburetor.

18. A two-cycle engine according to claim 1, wherein a narrowed section is formed in said carburetor in a section of said intake channel that is disposed upstream of said air channel.

19. A two-cycle engine according to claim 18, wherein said narrowed section is disposed approximately at a level of said butterfly valve.

20. A two-cycle engine according to claim 18, wherein said narrowed section is formed by a venturi section.

* * * * *